US005743800A

United States Patent [19]

Huard et al.

[11] Patent Number: 5,743,800

[45] Date of Patent: Apr. 28, 1998

[54] AUXILIARY GAME WITH RANDOM PRIZE GENERATION

[75] Inventors: Marcel Huard; Réal Bérubé, both of Québec, Canada

[73] Assignee: B.C.D. Mecanique Ltee., Quebec, Canada

[21] Appl. No.: 698,972

[22] Filed: Aug. 16, 1996

Related U.S. Application Data

[63] Continuation-in-part of PCT/CA95/00577, Oct. 16, 1995, continuation-in-part of Ser. No. 323,672, Oct. 18, 1994, abandoned.

[51] Int. Cl.[6] ..... A63F 9/22

[52] U.S. Cl. ..... 463/26; 463/16; 463/13; 463/12

[58] Field of Search ..... 463/16, 12, 13, 463/27, 17, 26; 465/25; 273/292, 148.13; 364/410, 412

[56] References Cited

U.S. PATENT DOCUMENTS

| | | |
|---|---|---|
| 4,760,527 | 7/1988 | Sidley . |
| 4,836,553 | 6/1989 | Suttle et al. . |
| 4,842,276 | 6/1989 | Darby . |
| 4,861,041 | 8/1989 | Jones et al. . |
| 4,948,134 | 8/1990 | Suttle et al. . |
| 5,022,653 | 6/1991 | Suttle et al. . |
| 5,078,405 | 1/1992 | Jones et al. . |
| 5,098,107 | 3/1992 | Boylan et al. . |
| 5,167,413 | 12/1992 | Fulton . |
| 5,217,224 | 6/1993 | Sincock . |
| 5,248,142 | 9/1993 | Breeding . |
| 5,282,620 | 2/1994 | Keesee . |
| 5,332,219 | 7/1994 | Marnell, II et al. . |
| 5,344,144 | 9/1994 | Canon . |
| 5,417,430 | 5/1995 | Breeding . |

FOREIGN PATENT DOCUMENTS

| | | |
|---|---|---|
| 2053812 | 6/1992 | Canada . |
| 2105856 | 9/1992 | Canada . |

*Primary Examiner*—Jessica Harrison
*Assistant Examiner*—Michael O'Neill
*Attorney, Agent, or Firm*—Michael D. Bednarek; Kilpatrick Stockton LLP

[57] ABSTRACT

An auxiliary game provides an auxiliary opportunity for players at a casino to win a prize by participating with a relatively small contribution each time they play a round in the principal casino game. To increase the element of random chance or luck in winning a prize in the game, a method and apparatus is provided for randomly choosing a winning card or combination of cards, or randomly selecting a person or group of persons eligible to win upon possession of the card or combination of cards. The amount of the prize can also be randomly selected either as a fixed amount or percentage of a maximum amount or a progressive jackpot.

25 Claims, 3 Drawing Sheets

AUXILIARY GAME WITH RANDOM PRIZE GENERATION

This application is a continuation-in-part application of U.S. patent application Ser. No. PCT/CA95/00577 filed Oct. 16, 1995, which is a continuation-in-part application of U.S. patent application Ser. No. 08/323,672 filed Oct. 18, 1994, now abandoned.

FIELD OF THE INVENTION

The present invention relates to a method and apparatus for controlling an auxiliary game or a progressive jackpot game which is part of a live casino game. More particularly, the invention relates to a method and apparatus for selecting a prize at random for participants in the auxiliary or progressive jackpot game.

BACKGROUND ART

A progressive jackpot game is an auxiliary game to a casino game in which an extra bet is placed at the time of placing a normal bet for the casino game. If the casino game player obtains a predetermined combination of cards or the like, and the player has decided to participate in the progressive jackpot game, then the player wins a portion of the progressive jackpot. The jackpot is progressive because it increases in value as players contribute to it by participating with the extra bet from one round or hand of the main game to the next. The extra bet is a fixed amount.

An appeal of the progressive jackpot is that an additional chance to win is presented in which gaming skill of the player or dealer is not an issue. For example, in a poker card game, the progressive jackpot player can win if he or she has any one of a predetermined number of high scoring hands. Usually, these high scoring hands would result in a win at the poker game. However, whether or not the high scoring hand will beat all other hands at the table is not important since it will qualify for a progressive jackpot win. Moreover, a player can only win in poker in proportion to his bet. The progressive jackpot game allows a player to bet modestly and yet win a substantial prize if his hand turns out to be high scoring, provided that he continues to place the small extra bet to participate in the progressive jackpot.

U.S. Pat. No. 4,861,041 to Jones et al. describes a progressive jackpot gaming method and apparatus in which winner selection is based solely on possession of any one of a few predetermined high scoring card arrangements by a participant.

U.S. Pat. No. 5,248,142 to Breeding describes a method and apparatus for a wagering game involving an auxiliary wager. The auxiliary wager is based on each player placing an additional gaming token on one of seven additional wager placing indicators in an additional wagering area provided at each player position. The additional wager placing indicators represent the various player positions. As part of the principal game, a random selection of a player takes places before commencing the principal casino game (e.g. in pai gow poker, the player to be dealt cards first is selected by random selection using dice or the like). If any given player places his or her token on an additional wager placing indicator representing the player position randomly selected, then the given player wins a prize in the auxiliary game. In Breeding, the method involves each player participating in the auxiliary game choosing which one of the player positions will be lucky and be chosen to be the first player position to be dealt cards in the principal game, and then placing the additional wager in the corresponding additional wager placing indicator. The additional wagering opportunities in Breeding are based on random events intrinsic to the principal casino game.

U.S. Pat. No. 5,332,219 to Marnell, II et al. describes an apparatus and method for playing an electronic poker game in which a bonus prize is awarded if a player's hand wins when a bonus symbol appears on one of the cards making up the winning combination of cards in the hand. A random bonus signal generator replaces at random card face images with the corresponding value card face image including the bonus symbol. The random replacement may be limited to only one card (e.g. the Queen of diamonds) with odds of replacement less than unity, or a plurality of cards may be subject to replacement with lower odds. Since the bonus symbol appears at the time the cards are dealt, the player must decide how to play the principal casino game based on whether a bonus prize in the auxiliary game is possible by keeping (and not discarding) the card or cards having the bonus symbol when attempting to form the highest possible ranking hand. Marnell, II et al. provides an electronic poker game which presents new strategy opportunities to a player, thereby increasing the mentally challenging aspects of a poker game. However, the auxiliary game in Marnell, II et al. changes the nature and strategies involved in playing the principal casino game, which can be upsetting to players familiar and comfortable with the strategies involved in playing the principal casino game.

SUMMARY OF INVENTION

It has been found that winner selection by possession of one of a few predetermined high scoring arrangements of cards lacks a certain appeal to players who are willing to take a chance on the extra bet for the progressive jackpot, but who do not expect to obtain a high scoring hand. A more random method of winner selection would be more appealing to players participating in an auxiliary game, because when the winner selection is more random, then anyone can win. The auxiliary game according to the invention may have a prize amount proportional to a total amount of contributions collected less any prize pay out (i.e. a progressive jackpot) or a fixed prize amount independent of an amount of contributions collected or of an amount of previously unawarded contributions.

According to the invention, there is provided a method and apparatus for selecting at random an element determining a winner in an auxiliary game. The element can be simply a player's position (seat), or a given card or combination of cards held by participants in the casino, at a table among all tables in the casino, or by a given participant. For example, blackjack players at three different tables may all participate in an auxiliary game. Predetermined prizes (i.e. percentages of the jackpot) are awarded to all participants who have high scoring hands, such as blackjack, twenty-one, or twenty with more than four cards. In addition to these prizes, a card is selected at random, and any participant (winner or loser) having this card in his hand wins a prize of a predetermined or randomly decided value. Similarly, the value of the prize can be increased, and the prize will be awarded to only participants at a randomly selected one of the three tables. Additionally, a given participant can be selected and a single card can be selected as the winning card for the progressive win. As can be appreciated, the perceived chance of winning comprises more luck than skill in the principal casino game.

The invention provides an auxiliary game in which a prize is determined by one or more of the following:

i) randomly choosing the winning card or combination of cards at the end of the principal game;

ii) randomly selecting at the end of the principal game from all participants one of the following: a) directly a winner; b) a single participant who may win if in possession of the card or combination of cards determined in i); and c) a table whose participants may win if in possession of the card or combination of cards determined in i); and iii) randomly selecting the amount of the prize either as a random fixed amount or a random percentage of the jackpot.

As mentioned above, a high scoring hand usually implies that a player will win whether he or she has participated in the auxiliary game or not. The invention extends the chance of winning the jackpot to both winners and losers, which encourages players to participate in the auxiliary game with every hand. In the case that the prize winner or potential prize winner is selected at random, it is also possible according to the invention to select a player among all players at random, whereby the selected player cannot win unless he or she also participated in the auxiliary game. This reminds all players that they may miss their chance unless they participate in the auxiliary game with every hand, especially when they witness a potential winner "miss out" because he or she did not participate.

Additionally, a player may be picked at random and given an opportunity, free of charge, to participate in the auxiliary game.

According to the invention, there is provided a method for playing an auxiliary prize game played along with a principal casino card game played by a plurality of players located at a plurality of player positions around a casino table. Each one of the players possesses a number of cards as a result of playing the principal casino card game, and the auxiliary prize game is played at the same time as playing the principal casino game. The method according to the invention comprises the steps of choosing at random a winning set of cards, playing the principal casino game to its normal conclusion, displaying to the players the winning set of cards, determining as being eligible to win a prize in the auxiliary game ones of the players possessing cards matching the winning set of cards, and awarding the prize to the players determined to be eligible to win. The winning set of cards chosen at random may be a single card, a random combination of cards, one of a plurality of predetermined combinations of cards representing specific ranks of hands recognized in the principal casino card game, or even a null set of cards consisting of no winning card.

According to a further embodiment of the invention, there is provided a method for playing an auxiliary prize game played along with a principal casino game played by a plurality of players located at a plurality of player positions around a casino table. The auxiliary prize game is played at the same time as playing the principal casino game. The method comprises the steps of choosing at random at least one of none, one or some of the player positions at an end of the principal game to obtain a chosen set of player positions, playing the principal casino game to its normal conclusion, indicating the chosen set of player positions, determining as being eligible to win a prize in the auxiliary game certain ones of the players located in the chosen player positions, and awarding the prize to the players determined to be eligible.

The invention also provides a method of playing an auxiliary game played along with a principal casino card game played by a plurality of players located at a plurality of player positions around a casino table in which each one of the players possesses a number of cards as a result of playing the principal casino card game and the auxiliary game is played at the same time as playing the principal casino game wherein the method comprises the steps of randomly selecting an amount of a prize in the auxiliary prize game, playing the principal casino game to its normal conclusion, determining as being eligible to win a prize ones of the players possessing cards matching a predetermined winning set of cards, and awarding a predetermined fraction of the maximum prize amount to the players determined to be eligible.

The invention further provides an apparatus for playing an auxiliary prize game played along with a principal casino game played by a dealer and a plurality of players seated at a plurality of player positions, the apparatus comprising: input means for generating a game state signal in response to a dealer command input; random selection means for generating at random a value representing a set of the player positions, the set consisting of at least one of none, some or all of the player positions; and selection indicating means for indicating based on the value and in response to the state signal which of the player positions have been selected whereby players located thereat are eligible to win a prize in the auxiliary prize game.

The invention still further provides an apparatus for playing an auxiliary prize game played along with a principal casino card game played by a dealer and a plurality of players seated at a plurality of player positions, the apparatus comprising: input means for generating a game state signal in response to a dealer command input; random selection means for generating at random a value representing a winning set of cards; and selection indicating means for indicating based on the value and in response to the game state signal the winning set of cards whose possession may render any one of the players eligible to win a prize in the auxiliary prize game.

The invention still further provides an apparatus for playing an auxiliary prize game played along with a principal casino game played by a dealer and a plurality of players seated at a plurality of played positions, the apparatus comprising: input means for generating a game state signal in response to a dealer command input; prize amount selecting means for generating at random a value representing a prize amount; and selection display means for indication based on the value and in response to the game state signal the prize amount which may be awarded in the auxiliary prize game.

BRIEF DESCRIPTION OF DRAWINGS

The invention will be better understood by way of the following detailed description of a preferred embodiment with reference to the appended drawing, in which.

DESCRIPTION OF PREFERRED EMBODIMENTS

First, the structure of the apparatus according to the preferred embodiment will be described, and thereafter the method of playing the auxiliary game will be described.

Figure 1:
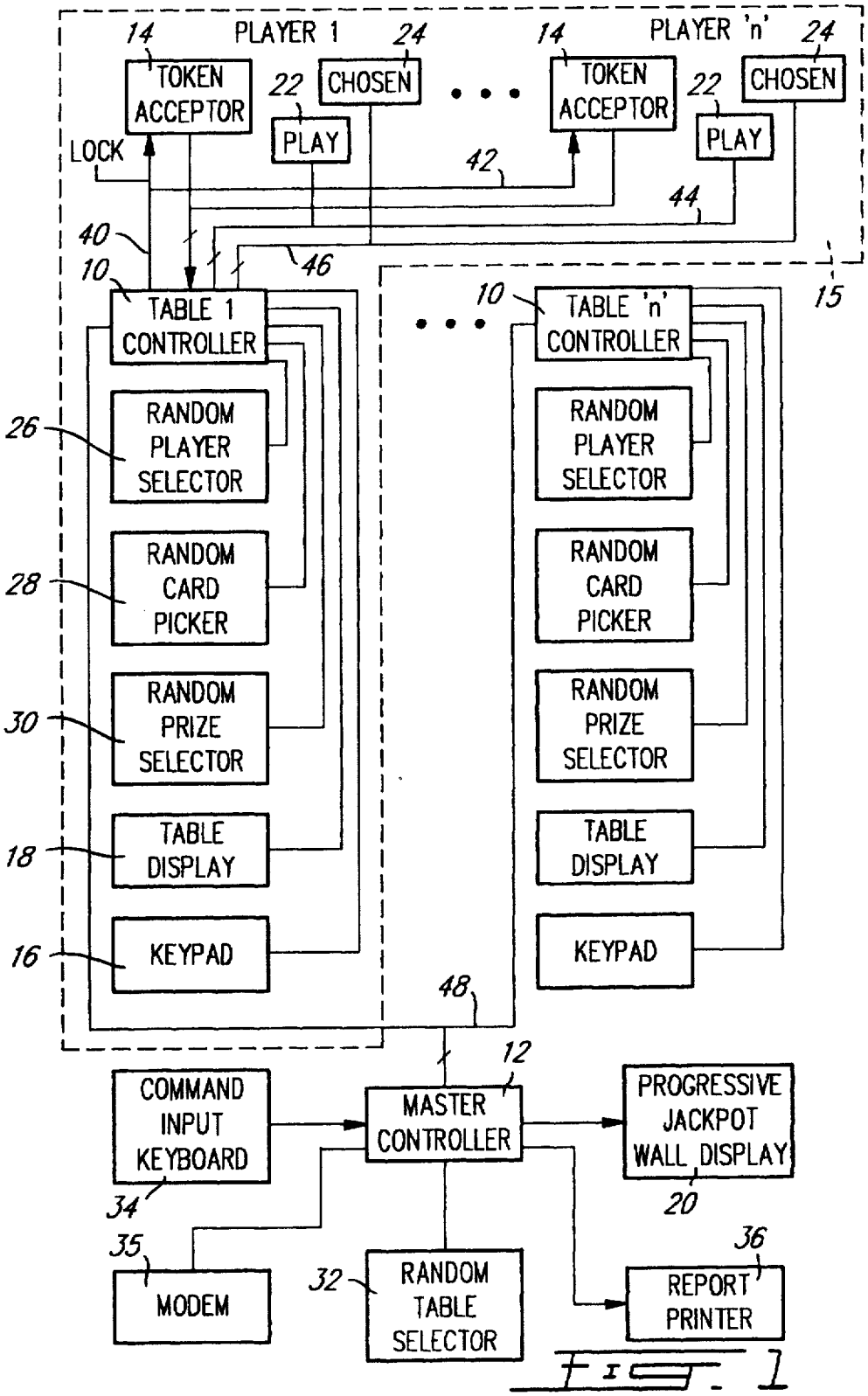
FIG. 1 is a block diagram of an auxiliary prize winner determining apparatus according to the preferred embodiment.
Figure 2:
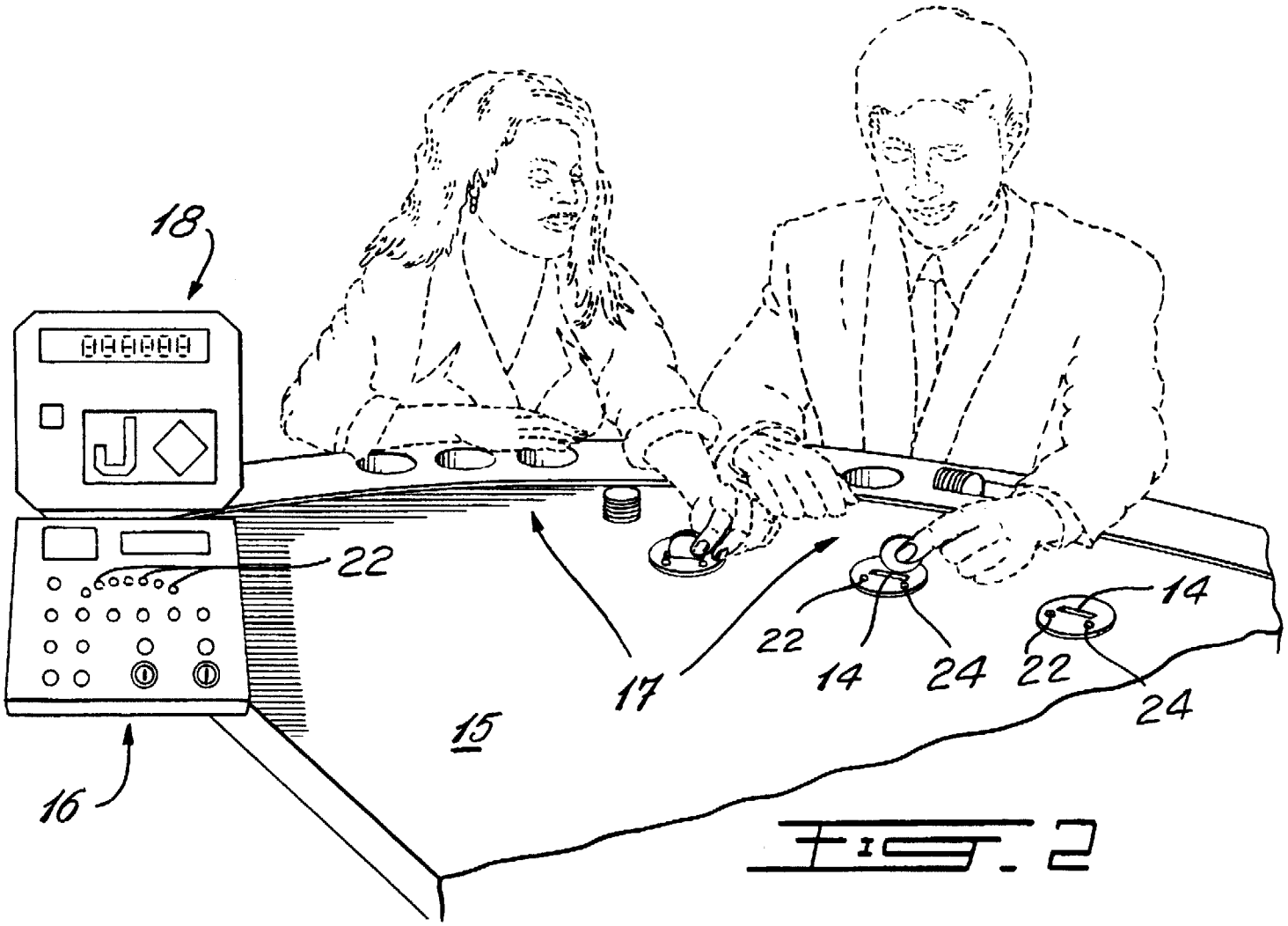
FIG. 2 is a perspective view of a casino table including the apparatus according to the preferred embodiment showing the player positions, the token acceptors, the player participation indicator means, the maximum prize amount table display and the dealer control input keypad.

As shown in FIGS. 1 and 2, the invention according to the preferred embodiment comprises at each casino card table 15 a plurality 'n' of player positions 17 each having a token acceptor 14, and a play indicator 22 consisting of an LED numeric display for indicating whether the player has put a token into acceptor 14 and is participating in the auxiliary game. The play display 22 shows the number of participations paid for which remain unused. An additional "chosen" LED 24 indicates whether the player has been chosen on a random basis to be eligible for winning a prize in the auxiliary game. In FIGS. 1 and 2, the invention is illustrated for convenience with indicator 24 as a separate unit from diplay 22, however, the function of indicating a chosen player is advantageously provided by connecting line 46 into a flash enable input of the display units 22 such that chosen player positions will have flashing numeric displays.

When a player wishes to participate in the auxiliary game, he or she inserts a token or coin into the acceptor 14. Alternatively, the player may pay the dealer directly and the dealer can use table keypad 16 to input the player's participation. The token acceptors 14 are initially locked out, i.e. line 40 is de-energized. When players insert tokens, the locking mechansims prevents the tokens from falling into the acceptors and leave the token half exposed for visual inspection by the dealer. When the principal casino game is to start, the deal presses the start key on keypad 16, and the lock signal on line 40 is energized for a brief period of time to unlock the token acceptors and allow any tokens to fall in. The controller 10 is connected to the token acceptors 14, and detects the tokens inserted. The controller registers the token insertion and increments the play indicator display 22 for the player position 17 at which the token was inserted by an amount equivalent to the value of the token inserted.

The random maximum prize amount selection is carried out by selector 30 and the controller displays the amount on display 18. At the end of the principal game, the dealer presses a "stop" key on the keypad 16 to signal the controller 10 that the principal game is over and that it is time to resolve winnings in the auxiliary game. The controller signals each of the means 26 and 28 to generate their respective values which are read by the controller 10 for subsequent use as described hereinbelow. Thereafter, the dealer resets the auxiliary game by pressing a key on the keypad 16, and the controller 10 sends a signal to displays 22 to decrement the number of paid for participations displayed on each unit 22. A zero value indicates a player who is not participating in the auxiliary game, and the display 22 will ignore a decrement signal when the value is zero.

At each gaming table, there is provided a controller 10 which is connected by buses 40,42,44,46 to units 14,22,24 at each player of the table. The controller 10 is connected to a dealer command input keypad 16 by which the dealer at the table operates the auxiliary game for the table, namely he inputs using the keypad 16 the state of the principal casino game, i.e. when the card game is at an end, when the next game is ready to start (i.e. ready to accept tokens for participating in the auxiliary game) and when the principal card game is under way. Separate keys on the keypad 16 may be provided for use by the dealer to signal the various states of the principal casino game. A random player selector 26 includes a computer random number generator (as is known in the computing art) for generating at random a value representing one of the players at the table, either assuming there may be a player at all positions at the table or taking into account which players are present as entered by the dealer at keypad 16. The value is indicated by selection indication means, namely player position number is displayed on a numeric display on the table display 18 and also the "chosen" LEDs 24 are illuminated (or flashing of the play displays 22 is signaled) by controller 10 as a function of the value generated by selector 26.

A winning "magic" card or combination of cards are picked anew for each card game round using a random number generator 28 picking cards from a virtual deck of cards. The random card selection means 28 generates a value representing a winning set of cards. The winning set of cards can comprise a single "magic" card, a number of "magic" cards not constituting a scoring combination of cards according to the rules of the principal casino game, or one of the many scoring combination of cards. When picking magic cards, the whole deck may be used, or a subset of the normal playing card deck may be used. Of course, cards from an actual deck could also be picked. Picking from an actual deck of cards can be done at random using a mechanical card selection device. Computer software card games which randomly pick cards from a virtual deck of cards are known in the art. In the preferred embodiment, the value of the prize which may be won by the "chosen" player possessing cards which correspond to or "match" the picked magic card or the selected combination of cards is determined by random prize selector 30. The random prize selector generates at random a value representing the maximum prize amount. Of course, the prize won may be a percentage of the maximum prize amount or a fixed amount depending on the rules of the auxiliary game.

A display 18 is also connected to controller 10 for displaying the magic card or the combination of cards which are eligible to win, as well as the position 17 of the player who is eligible to win and the amount which can be won. The display 18 can be a monitor placed in a location where both the dealer and the players can see it (see FIG. 2).

A master controller 12 is provided for controlling the auxiliary game for a group of tables or even for the whole casino. An input keyboard 34 is connected to controller 12 for command input. One or more wall display units 20 are also connected to the controller 12 for showing the amount of the auxiliary prize. The wall display unit 20 is an alpha-numeric display which can be used to display text messages for promoting the auxiliary game by announcing winners and providing information about playing the auxiliary game. Since the controller 12 can also decide on a random basis which tables are selected to be eligible to win, a random table selector 32 is provided. Table selection can be weighted based on participation at each table. A report printer 36 is also connected to controller 12 for printing up daily performance reports.

As can be appreciated, the table controller 10 and units 16,18,26,28,30 could be integrated into a personal computer provided with a controller I/O card for the buses 40,42,44, 46, network communications link between the computer and the master controller 12, and the appropriate control software. The master controller 12 can also be controlled remotely via a modem 35. In this way, it would even be possible to have an auxiliary prize shared among several casinos with one computer centrally controlling the master controllers 12 at various casino locations by modems 35.

Figure 3:
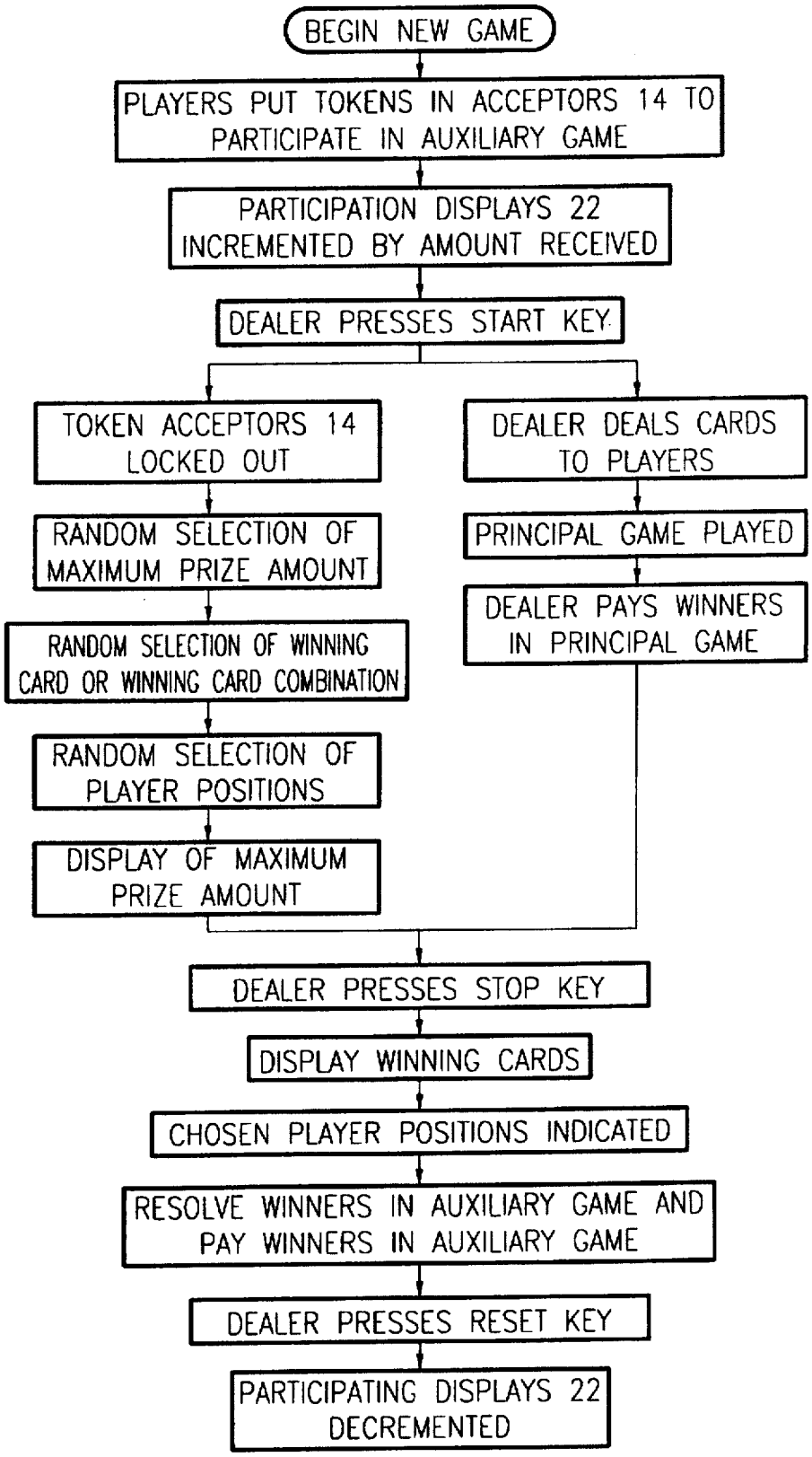
FIG. 3 is a flow diagram illustrating the method according to the preferred embodiment.

As shown in FIG. 3, in the preferred embodiment, at the beginning of each new game in the principal casino card game, the dealer presses a reset key on the keypad. In response to this signal, the LEDs 22 and 24 are turned off and the token acceptors 14 are unlocked to reset the apparatus according to the invention and prepare for a new round or a new game. The players then place tokens in the acceptors 14 to participate in the auxiliary game. As each player places his or her token in the token acceptors, the corresponding LED 22 turns on. When the dealer is then ready to start the principal casino game after the players have had an opportunity to place their tokens in acceptors 14, the dealer presses the start key on the keypad. In response to this signal, the token acceptors are locked out, and the random means according to the invention for selecting player winning card or cards and prize amounts are activated to select a new maximum prize amount, a new winning card or winning card combination and a new selection of player positions at random. In the preferred embodiment, the maximum prize amount is displayed immediately on the table display 18 for the benefit of the players to know in advance how much they stand to win in the auxiliary game.

After pressing the start key on the keypad, the dealer then commences to deal cards to the players and begin playing the principal casino card game. The principal casino card game is played to its normal conclusion and the dealer pays winners in the principal game. The dealer then presses the game stop key on the keypad to signal that the game is over. This signal causes the table controller 10 to display the winning card or combination of cards and the "chosen" player position on display 18. The "chosen" player position is also indicated by sending a signal on bus 46 to cause the chosen player position's play display 22 to flash. The dealer then resolves winners in the auxiliary game based on which players possess cards which match the randomly selected winning card or combination of cards and which players have been randomly selected as indicated by the chosen indicator means 24 positioned in front of each player. In the preferred embodiment, having a chosen indicator means 24 illuminated in front of a player increases the amount that that player may win if the chosen player also possesses the cards matching the displayed winning cards. If the player possesses the displayed winning cards but is not selected as indicated by the chosen player position indicator means 24, the prize to be won in the auxiliary game is a smaller prize. In the preferred embodiment, the maximum prize amount displayed is an amount which influences at least some of the prizes to be awarded. For example, in the case of a "magic" card, possession of the magic card may result in a small prize such as three or four tokens in absence of the player having the selected magic card also being a player whose chosen indicator is activated, while if a chosen player is in possession of the magic card, the prize may be twenty tokens. Alternatively, the amount of the prize to be awarded in the auxiliary game may simply be doubled as a result of being selected as indicated by the chosen indicator means 24.

Finally, by pressing the reset key, the dealer causes the participating displays 22 to be decremented by one participation unit. The deduction is made at the end of bet pay out since the display is used as proof of participation during pay out.

While in the preferred embodiment, the principal casino game is a card game such as twenty-one, poker or baccarat, the invention may be used with other casino games, such as roulette and craps. In such case the gaming symbols are not card values, but rather the values associated with those games. For example, in roulette the numbers and/or colors of the notches in which the ball lands, and in craps the numbers of each die cast are the gaming symbols from which the random gaming symbol picker 28 picks as the winning symbol for the auxiliary game. Of course, possession of gaming symbols in the context of craps and roulette refers to the players' selection of the gaming symbols as a result of betting on them, rather than receiving and possibly keeping physical playing cards as is the case in card games. Player positions at such gaming tables are similar as with casino card games.

In the preferred embodiment, the random selection of the chosen player and the random selection of the winning card or cards is displayed after the dealer presses the stop key. This is done to prevent the auxiliary game from interfering with the principal game. Knowledge of the winning card may disrupt playing strategy in the principal game and likewise the chosen player may react differently in the principal game if this status announced at the beginning of play. However, there are some games such as blackjack in which there is no discarding and a priori knowledge of a selected "magic card" will not adversely affect play. In fact, in the game of blackjack which is commonly played with a number of 52 card decks mixed together it is possible to have the same "magic card" appear in the same hand a number of times, particularly if the selected magic card has a value less than five. In this case, a large prize in the auxiliary game is awarded for multiple possession of the magic card in the same hand. In such circumstances in which a priori knowledge of the selected card is not disruptive to playing the principal game, the "stop" key need not be used, and the display of the magic card and the chosen player is carried out after pressing the start key. Furthermore, the same "magic" card may be used for a series of games in the principal card game. This actually makes the auxiliary game easier to play since each player can remember what the winning card in the auxiliary game is without always needing to consult the display and check the cards carefully.

An example of the operation of the preferred embodiment will now be described. The object of the auxiliary game is to add to the principal casino game an additional chance of winning which is distinct from the principal game. This may be done in one of two ways. First, the chance of winning in the auxiliary game is unrelated to the chance of winning in the casino game. Second, the chance of winning a much larger bonus prize from the auxiliary prize amount is present when a high scoring arrangement of cards is obtained even if the amount bet in the principal game was small. An example of the first way is a loser in the principal game who participates in the auxiliary game and possesses the winning cards for the auxiliary prize win on the basis of randomly picked cards. An example of the second way is the player who participates in the auxiliary game and obtains the highest scoring card combination, such as a Royal Flush in poker or a given combination totaling twenty-one in blackjack. In the first way, the auxiliary prize win is achieved by chance unrelated to the principal game. In the second way, the jackpot win is a bonus to what should be a winning hand in the principal game. In the example, both ways of winning are combined. Ultimately, the player who participates in the auxiliary game loses none of the excitement and rewards of the principal game while gaining an additional incentive to continue playing.

In the present invention, there is an additional random element associated with winning an auxiliary prize. The system can choose at random any player or participant, or table of players to be eligible to win the random bonus prize. All players who pay to participate in the auxiliary game will win if in possession of the predetermined high scoring card combinations. In the case of poker, these combinations are: royal flush, straight flush, four of a kind, full house, flush, straight and three of a kind. The prize awarded for these combinations are a percentage of the maximum prize amount, the percentage being different for each combination as an inverse proportion to the chances of obtaining the combination.

The prize awarded for possession of the magic card can be a small fixed amount and can be won by all participants having a picked card termed the magic card. In poker, a player has five cards and the odds of having one of 52 cards is about 1:10. For poker players, the prize may be small, such as 4 tokens. This prize could be paid, or simply be given as a credit to the player's position for future participation. In twenty-one, most players will take only a few cards, so the odds of having the magic card without busting are smaller. For twenty-one players, the prize could be 12 tokens. Again the prize could be paid or taken in credits, and the prize amount could be increased (e.g. doubled) if the winning player is also indicated as being randomly chosen.

The invention also allows for more interesting versions of the random bonus prize determination. For instance, the master controller can select a table at random in the casino to be a grand prize winner. The selected table could announce to participants after accepting tokens for the game that the magic card bonus prize value is significantly larger, namely ten times greater. Alternatively, the master controller could simply instruct the table controller 10 of the selected table to pick at random one of its participants for the purposes of awarding a bonus prize without any requirement of possession of a given card.

The random card picker 28 at each table can also be used to pick out two cards at random from the virtual deck as being the magic cards. Possession of two cards involves much lower odds, and the pay back for the two card combination can be significant, e.g. 20 tokens in the case of poker. The random card combination can also be one of a set of card combinations having a medium scoring value, e.g. a red or black pair of any rank, a pair of rank ten or greater, and three of a kind. The value of the prize awarded can take into consideration the odds of having the particular combination of cards selected.

As can be appreciated, the prize amount could be determined by a total of a portion of player contributions less any winnings paid out, i.e. a progressive jackpot. The prize amount for the possession of a randomly picked card or for being seated at a randomly chosen player position could be randomly chosen, while a progressive jackpot is maintained for the auxiliary prize awarded for obtaining the predetermined high ranking combination of cards. In such an arrangement, the random prize amounts paid out may be deducted from the progressive jackpot. Alternatively, the random prize selection may randomly select a percentage of the jackpot to be awarded, either for the predetermined high ranking combinations of cards or for the magic card, the percentage awarded for the magic card being substantially less than for a high ranking hand (e.g. 1–5%).

As can be appreciated, the invention could also comprise for each player position a player participation control device which includes a display for showing a number of prepaid participations (a monetary amount) and input keys, namely for example, a key to participate in the current auxiliary game and deduct a credit from the amount displayed, a key to hold a player's credits while no participation takes place (the player may take a washroom break), a key to increase (e.g. double) a player's participation in the auxiliary game with a corresponding increase in pay back, and a key to gamble the player's auxiliary prize winnings (e.g. at least small winnings) at even odds (e.g. double or nothing with a 50% chance of doubling). The state of the control device can be indicated by LEDs or other indicator means, so that it is clear whether the player is participating, participating with an increased participation, or holding. The keys could be integrated into the token acceptor unit 14 mounted onto the gaming table.

We claim:

1. A method for playing a game consisting of an auxiliary prize game played along with a principal casino game played by a plurality of players located at a plurality of player positions around a casino table, each one of said players possessing a number of gaming symbols as a result of playing said principal casino game, said auxiliary prize game being played at the same time as playing the principal casino game, the method comprising the following steps:

said players paying to participate in said game;

choosing at random a winning set of gaming symbols;

playing said principal casino game to its normal conclusion;

displaying to said players said winning set of gaming symbols;

determining as being eligible to win a prize in said auxiliary game ones of said players possessing gaming symbols matching said winning set of gaming symbols; and awarding said prize to said players determined to be eligible in the previous step.

2. The method as claimed in claim 1, wherein said step of determining further comprises said players paying an auxiliary wager to be eligible to win said prize.

3. The method as claimed in claim 1, further comprising steps of:

choosing at least one of none, one and some of said player positions at an end of the principal game to obtain a chosen set of player positions; and indicating which of said player positions are chosen, said step of determining further comprising excluding ones of said players not located at a randomly selected one of said player positions from being eligible to win said prize.

4. The method as claimed in claim 2, further comprising steps of:

choosing at random one of none, one and some of said player positions at an end of the principal game to obtain a chosen set of player positions; and indicating which of said player positions are chosen, said step of determining further comprising excluding ones of said players not located at a randomly selected one of said player positions from being eligible to win said prize.

5. The method as claimed in claim 1, further comprising a step of randomly selecting as a maximum amount of a prize in the auxiliary prize game an amount value randomly picked according to a predetermined distribution from a range of values, wherein said step of awarding comprises awarding a predetermined fraction of said maximum prize amount to said players determined to be eligible.

6. The method as claimed in claim 1, further comprising steps of:

choosing at random one of none, one and some of said player positions at an end of the principal game to obtain a chosen set of player positions; and indicating which of said player positions are chosen, said step of awarding further comprising awarding a bonus prize amount to ones of said players possessing cards matching said winning set of cards who are also located at one of said chosen player positions.

7. The method as claimed in claim 1, wherein said principal casino game is a card game, and said gaming symbols represent playing cards.

8. A method for playing a game consisting of an auxiliary prize game played along with a principal casino card game played by a plurality of players located at a plurality of player positions around a casino table, each one of said players possessing a number of cards as a result of playing said principal casino game, said auxiliary prize game being played at the same time as playing the principal casino game, the method comprising the following steps:

said players paying to participate in said game;

choosing at random one of none, one and some of said player positions at an end of the principal game to obtain a chosen set of player positions;

playing said principal casino game to its normal conclusion;

indicating said chosen set of said player positions;

determining as being eligible to win a prize in said auxiliary game ones of said players located in said chosen player positions and possessing cards matching a winning set of cards; and awarding said prize to said players determined to be eligible in the previous step.

9. The method as claimed in claim 8, wherein said step of determining further comprises said players paying an auxiliary wager to be eligible to win said prize.

10. The method as claimed in claim 8, further comprising a step of choosing at random said winning set of cards.

11. The method as claimed in claim 9, further comprising a step of choosing at random said winning set of cards.

12. The method as claimed in claim 8, further comprising a step of randomly selecting as a maximum amount of a prize in the auxiliary prize game an amount value randomly picked according to a predetermined distribution from a range of values, wherein said step of awarding comprises awarding a predetermined fraction of said maximum prize amount to said players determined to be eligible.

13. The method as claimed in claim 8, wherein said prize is a bonus prize awarded in addition to a regular prize in said auxiliary game, said regular prizes being awarded independently of player position selection.

14. A method of playing a game consisting of an auxiliary prize game played along with a principal casino game played by a plurality of players located at a plurality of player positions around a casino table, each one of said players possessing a number of gaming symbols as a result of playing said principal casino game, said auxiliary game being played at the same time as playing the principal casino game, the method comprising the following steps:

said players paying to participate in said game;

randomly selecting as an amount of a prize in the auxiliary prize game an amount value randomly picked according to a predetermined distribution from a range of values;

playing said principal casino game to its normal conclusion;

determining as being eligible to win the prize ones of said players possessing gaming symbols matching a predetermined winning set of gaming symbols; and awarding a predetermined fraction of said maximum prize amount to said players determined to be eligible in the previous step.

15. The method as claimed in claim 14, further comprising steps of:

accepting an auxiliary game participation amount from ones of said players who want to participate in said auxiliary prize game; and indicating which one of said players have given said participation amount and are participating in said auxiliary game; wherein said step of determining includes excluding ones of said players who are not participation as being eligible to win.

16. An apparatus for playing a game consisting of an auxiliary prize game played along with a principal casino game played by a dealer and a plurality of players seated at a plurality of player positions at a casino gaming table, the players possessing a number of gaming symbols as a result of playing said principal casino game, the apparatus comprising:

input means for generating a game state signal in response to a dealer command input;

random selection means for generating at random a value representing at least one of:

(a) a set of said player positions, said set consisting of one of none, some and all of said player positions, (b) a winning set of gaming symbols associated with normal play of said principal casino game, (c) an amount of a prize to be won in said auxiliary game, said value being an amount value randomly picked according to a predetermined distribution from a range of values; and selection indicating means for indicating based on said value and in response to said state signal at least one of: ones of said player positions having been selected; the selected winning set of gaming symbols; and the selected prize amount, whereby players enjoy an extra random component in the determination of winnings in said auxiliary prize game.

17. The apparatus as claimed in claim 16, further comprising indicator means provided at each of said player positions for indicating whether a player at each position has contributed an amount at the beginning of said principal game to participate in the auxiliary game, said indicator means being reset at an end of said principal game.

18. The apparatus as claimed in claim 17, wherein said indicator means include a token accepting apparatus and a light at each of said player positions.

19. The apparatus as claimed in claim 16, wherein said random selection means randomly select a group of said player positions located at a common gaming table of said principal game.

20. The apparatus as claimed in claim 16, wherein said principal casino game is a card game, said gaming symbols represent playing cards, and said random selection means select a winning playing card symbol, whereby eligible players must possess the winning card to collect the prize.

21. The apparatus as claimed in claim 16, wherein said principal casino game is a card game, said gaming symbols represent playing cards, and said random selection means select a winning hand or combination of playing card symbols, whereby eligible players must possess the winning card combination to collect the prize.

22. The apparatus as claimed in claim 16, wherein said selected prize amount is a maximum prize amount to be awarded, said selection indicating means comprising display means for displaying said maximum prize amount.

23. The apparatus as claimed in claim 22, wherein said auxiliary prize is a cumulative jackpot whose value is a function of player contribution, said maximum prize amount being calculated as a random percentage of a total value of said progressive jackpot.

24. The apparatus as claimed in claim 17, wherein said state is at an end of said principal game, said indicator means comprising a reset switch for resetting said indicator means after determination of winners in said auxiliary game.

25. A method for playing a game consisting of an auxiliary prize game played along with a principal casino game played by a plurality of players located at a plurality of player positions around a casino table, each one of said players possessing a number of gaming symbols as a result of playing said principal casino game and being eligible to win a prize in said auxiliary prize game if in possession of gaming symbols matching a winning set of gaming symbols displayed to said players, said auxiliary prize game being played at the same time as playing the principal casino game, the method comprising the following steps:

said players paying to participate in said game;

choosing at random said winning set of gaming symbols, said winning set of gaming symbols normally representing gaming symbols of low value in said principal casino game;

playing said principal casino game to its normal conclusion;

determining as being eligible to win a prize in said auxiliary game ones of said players possessing gaming symbols matching said winning set of gaming symbols; and awarding said prize to said players determined to be eligible in the previous step.

* * * * *